US008492994B2

(12) United States Patent
Braun et al.

(10) Patent No.: US 8,492,994 B2
(45) Date of Patent: Jul. 23, 2013

(54) METHOD AND CIRCUIT ARRANGEMENT FOR MAKING A LAMP WATTAGE AVAILABLE FOR OPERATING AT LEAST ONE GAS DISCHARGE LAMP

(75) Inventors: Alois Braun, Neuburg (DE); Walter Limmer, München (DE); Maximilian Schmidl, Pullach (DE)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 228 days.

(21) Appl. No.: 13/125,157

(22) PCT Filed: Oct. 22, 2008

(86) PCT No.: PCT/EP2008/064275

§ 371 (c)(1),
(2), (4) Date: Apr. 20, 2011

(87) PCT Pub. No.: WO2010/045970

PCT Pub. Date: Apr. 29, 2010

(65) Prior Publication Data

US 2011/0221354 A1 Sep. 15, 2011

(51) Int. Cl.
*H05B 41/28* (2006.01)
*H05B 41/392* (2006.01)

(52) U.S. Cl.
USPC ..... 315/291; 315/269; 315/299; 315/307

(58) Field of Classification Search
USPC ..... 315/291, 269, 282, 299, 307, 326, 315/DIG. 7
See application file for complete search history.

(56) References Cited

U.S. PATENT DOCUMENTS

| | | | | |
|---|---|---|---|---|
| 5,933,340 | A * | 8/1999 | Adamson | 363/97 |
| 2002/0140373 | A1 | 10/2002 | Ribarich | |
| 2003/0080696 | A1 | 5/2003 | Tang et al. | |
| 2008/0111497 | A1 * | 5/2008 | Yanai et al. | 315/291 |

FOREIGN PATENT DOCUMENTS

| | | |
|---|---|---|
| CN | 2770272 | 4/2006 |
| CN | 2935618 | 8/2007 |
| EP | 0 763 312 | 9/2001 |

* cited by examiner

*Primary Examiner* — Daniel D Chang
(74) *Attorney, Agent, or Firm* — Cozen O'Connor

(57) ABSTRACT

A method for making a lamp wattage available for operating at least one gas discharge lamp depending on a dimming signal which is input into a wattage factor correction circuit, having a switch element that is switched on clocked by a switch-on time, wherein the wattage factor correction circuit emits an intermediate circuit voltage which in turn is input into a converter that makes the lamp wattage available, comprising the steps of: in an operating phase in which the dimming signal has no phase leading edge and no phase trailing edge, the wattage factor correction circuit and the converter are regulated independently of each other using a separate regulating circuit in each case; and in an operating phase in which the dimming signal has a phase leading edge or a phase trailing edge, the two independent regulating circuits are coupled to each other via a higher-order third regulating circuit such that the lamp wattage of the converter is adjusted such that the switch-on time of the switch element in the wattage factor correction circuit corresponds to a predetermined time.

11 Claims, 5 Drawing Sheets

Figure 1:
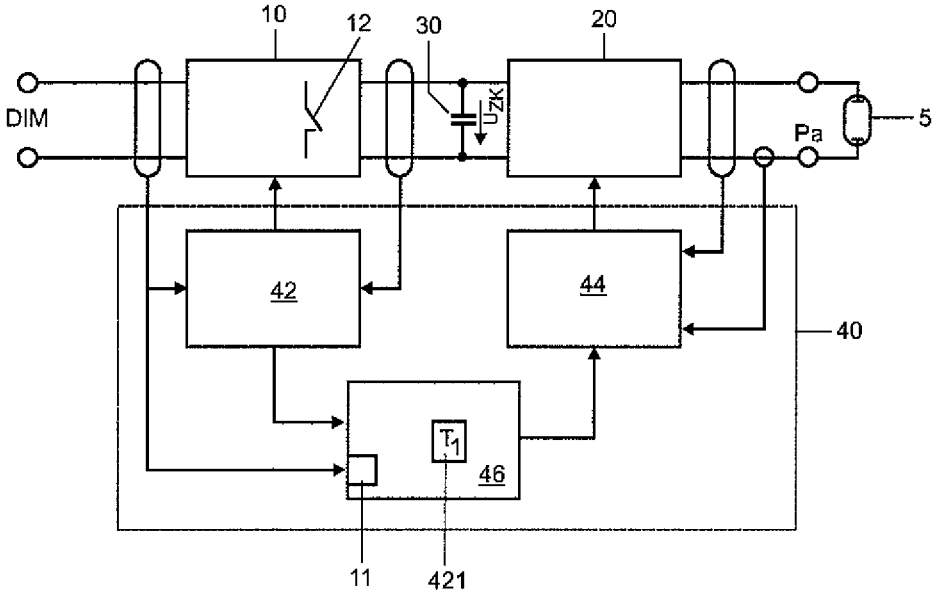

METHOD AND CIRCUIT ARRANGEMENT FOR MAKING A LAMP WATTAGE AVAILABLE FOR OPERATING AT LEAST ONE GAS DISCHARGE LAMP

RELATED APPLICATIONS

This is a U.S. national stage of application No. PCT/EP2008/1064275, filed on Oct. 22, 2008.

FIELD OF THE INVENTION

1. Technical Field

The invention relates to a method for making a lamp wattage available for operating at least one gas discharge lamp depending on a dimming signal which is input into a wattage factor correction circuit having a switch element that is switched on clocked by a switch-on time, the wattage factor correction circuit emitting an intermediate circuit voltage which in turn is input into a converter that makes the lamp wattage available.

The invention likewise relates to a circuit arrangement having an input for supplying a dimming signal, an output for making a lamp wattage available for operating at least one gas discharge lamp, a wattage factor correction circuit connected to the input with a controllable clocked switch element having a control input to ensure a uniform power input of the circuit arrangement, a converter connected to the output for generating the lamp wattage, an intermediate circuit voltage that is present at the output of the wattage factor correction circuit and at the input of the converter, and a control unit having a control output for making available a control signal for the wattage factor correction circuit and a control signal for the converter at the control output.

2. Background of the Invention

Previous ballasts that make a variable lamp wattage available measure the phase angle of the phase leading edge or phase trailing edge of the dimming signal and adjust a dimming wattage on the lamp which correlates with the phase angle of the dimming signal. However, to this end a precise measurement of the phase angle is necessary, which makes necessary either an expensive additional circuit with a considerable requirement for components or in the case of digital processing a fast and thus expensive processor which samples the dimming signal at a high sampling rate.

OBJECT

One object of the invention is to provide a method for making a lamp wattage available for operating at least one gas discharge lamp depending on a dimming signal which is input into a wattage factor correction circuit having a switch element that is switched on clocked by a switch-on time, the wattage factor correction circuit outputting an intermediate circuit voltage which in turn is input into a converter that makes the lamp wattage available, said method using fewer resources for its execution than the methods known in the prior art.

Another object of the invention is to provide a circuit arrangement for making a lamp wattage available for operating at least one gas discharge lamp with an input for supplying a dimming signal, an output for making a lamp wattage available for operating at least one gas discharge lamp, a wattage factor correction circuit connected to the input with a controllable clocked switch element having a control input for ensuring a uniform power input of the circuit arrangement, a converter connected to the output for generating the lamp wattage, an intermediate circuit voltage which is present at the output of the wattage factor correction circuit and at the input of the converter, and a control unit having a control output for making available a control signal for the wattage factor correction circuit and a control signal for the converter at the control output, which can be assembled less expensively and with less use of components than the circuit arrangements known in the prior art.

One aspect of the invention is directed to a method for making a lamp wattage available for operating at least one gas discharge lamp depending on a dimming signal which is input into a wattage factor correction circuit having a switch element that is switched on clocked with a switch-on time, the wattage factor correction circuit emitting an intermediate circuit voltage which in turn is input into a converter that makes the lamp wattage available, and in an operating phase in which the dimming signal has no phase leading edge and no phase trailing edge the wattage factor correction circuit and the converter are regulated independently of each other with their own regulating circuit in each case, and in an operating phase in which the dimming signal has a phase leading edge or a phase trailing edge, the two independent regulating circuits are coupled to each other via a higher-order third regulating circuit such that the lamp wattage of the converter is adjusted such that the switch-on time of the switch element in the wattage factor correction circuit corresponds to a predetermined time.

An advantageous embodiment of the method includes the following repeatedly executing steps:

- recognizing whether the dimming signal has a phase leading edge or a phase trailing edge,
- regulating the switch-on time of the switch element such that the intermediate circuit voltage corresponds to a predetermined value and saving a first variable that represents a dimension of a first switch-on time of the switch element, as well as regulating the lamp wattage of the converter such that it matches a rated wattage of the discharge lamp if it was recognized that the dimming signal has no phase leading edge and no phase trailing edge,
- reading in a first variable that represents a dimension of a first switch-on time of the switch element, and reducing the lamp wattage of the converter such that the switch element is in each case closed for the duration of the first switch-on time if it was recognized that the dimming signal has a phase leading edge or a phase trailing edge.

Thanks to this measure it is possible, using minimal components and computing effort, to produce a correlation between the power output to the lamp and the phase angle of the dimming signal.

In a development a second variable that represents a dimension of a first crest voltage value of the dimming signal is furthermore simultaneously saved with the first variable, and the following additional steps are executed:

- measuring an instantaneous crest voltage ($\hat{U}_a$) of the dimming signal,
- reading in the second variable that represents a dimension of a first crest voltage value ($\hat{U}_1$),
- weighting the measured instantaneous crest voltage with the read-in first crest voltage value which emerges from the second variable such that the lamp wattage of the converter is adjusted such that the current switch-on time of the switch element satisfies the following formula:

$$T_{ON} = T_1 \cdot \frac{\hat{U}_1}{\hat{U}_a} \cdot C;$$

C is here a correction factor dependent on the lamp wattage.

By this measure the dimming level of the connected gas discharge lamp can be maintained independently of the crest voltage value of the dimming signal.

For many discharge lamps, in particular high-pressure discharge lamps, it is advantageous if the dimming signal is made available by a phase leading edge dimmer or phase trailing edge dimmer which has a dimming range of 50%-100%. In this way shortcomings that occur at a dimming level of below 50% can be avoided.

In a further embodiment a third variable that represents a dimension of a first lamp wattage ($P_1$) of the converter (20) is saved before the gas discharge lamp (5) is switched off, and the following steps are executed when the gas discharge lamp is switched back on:

reading in the first and the third variable, comparing the first lamp wattage with a predetermined lamp startup wattage, controlling the converter such that the lamp wattage matches the first lamp wattage of the discharge lamp if the first lamp wattage is greater than or equal to the predetermined lamp startup wattage, controlling the converter such that the lamp wattage matches the predetermined lamp startup wattage of the discharge lamp if the first lamp wattage is smaller than the predetermined lamp startup wattage, waiting for a predetermined period of time, controlling the converter such that the lamp wattage has a variable, whereby the switch element is in each case closed for the duration of the calculated switch-on time.

By this measure the dimming level adjusted by the user is saved when the gas discharge lamp is switched off, and is readjusted when the gas discharge lamp is switched back on.

Another aspect of the present invention is directed to a circuit arrangement for making a lamp wattage available for operating at least one gas discharge lamp with:

an input for supplying a dimming signal, an output for making a lamp wattage available for operating at least one gas discharge lamp, a wattage factor correction circuit connected to the input with a controllable clocked switch element having a control input for ensuring a uniform power input of the circuit arrangement, a converter connected to the output for generating the lamp wattage, an intermediate circuit voltage which is present at the output of the wattage factor correction circuit and at the input of the converter, and a control unit having a control output for making a control signal available for the wattage factor correction circuit and a control signal for the converter at the control output, the circuit arrangement having a first storage element connected to the control unit for saving a first variable that represents a dimension of a first switch-on time of the switch element, having a detection unit connected to the input, which is designed in order to determine whether the dimming signal has a phase leading edge or a phase trailing edge, in the event of a full wave being detected (no phase leading edge and no phase trailing edge) the first variable that represents a dimension of the first switch-on time of the switch element, saved in the first storage element, regulates the converter such that a lamp wattage is present at the output that matches a rated wattage of the gas discharge lamp, and in the event of a phase leading edge or a phase trailing edge being detected, reads out the first variable for the first switch-on time from the storage element and adjusts the lamp wattage by controlling the converter such that the switch element of the wattage factor correction circuit is in each case closed for the duration of the switch-on time. By this measure it is possible, using minimal components and computing effort, to produce a correlation between the power output to the lamp and the phase angle of the dimming signal.

Advantageously the detection unit samples the dimming signal at a frequency that satisfies the following correlation: $f_a \geqq 0.01 \cdot f_{DIM}$. This ensures that the circuit arrangement uses minimal components and computing effort in order to be able to detect a phase leading edge or a phase trailing edge.

If the control unit is furthermore designed to save a second variable in a second storage element that represents a dimension of a first crest voltage value of the dimming signal, it can measure an instantaneous line voltage crest of the dimming signal, and weight the measured instantaneous line voltage crest with the first crest voltage value which emerges from the second variable such that the lamp wattage is made available by controlling the converter at a level such that the switch-on time of the switch element satisfies the following formula:

$$T_{ON} = T_1 \cdot \frac{\hat{U}_1}{\hat{U}_a} \cdot C;$$

C is here a correction factor dependent on the lamp wattage. By this measure the dimming level of the connected gas discharge lamp can be maintained independently of the crest voltage value of the dimming signal.

In a further embodiment the circuit arrangement has a further storage element for saving a third variable before the gas discharge lamp is switched off, the third variable representing a dimension of a first lamp wattage, and the circuit arrangement furthermore having the following features:

a mimic for reading in the first and the third variable after the gas discharge lamp is switched on, a comparator for comparing the first lamp wattage to a predetermined lamp startup wattage, a device for controlling the converter such that the lamp wattage matches the first lamp wattage of the gas discharge lamp if the first lamp wattage is greater than or equal to the predetermined lamp startup wattage, a device for controlling the converter such that the lamp wattage matches the predetermined lamp startup wattage of the gas discharge lamp if the first lamp wattage is smaller than the predetermined lamp startup wattage, a delay device which allows the wattage applied to the gas discharge lamp to be applied for a predetermined period of time, a regulating circuit for adjusting the converter such that the lamp wattage has a variable, whereby the switch element in each case is closed for the duration of the calculated switch-on time.

By this measure the dimming level adjusted by the user is saved when the gas discharge lamp is switched off, and is readjusted when the gas discharge lamp is switched back on.

Particularly advantageously the control unit has a microcontroller, and the detection unit is formed by corresponding wiring and software of the microcontroller. This measure promises the minimal component requirement, since a microcontroller is already present in most circuit arrangements for other reasons, and the additional functionality can essentially be added by upgrading the software of the microcontroller.

The rated wattage of the gas discharge lamp is here regarded as the nominal wattage of the gas discharge lamp specified by the lamp manufacturer. The nominal wattage, in other words the rated wattage, corresponds to a dimming level of 100%

All kinds of power converters are here regarded as converters, regardless of whether they emit a d.c. voltage or an a.c. voltage at the output. A converter in the above sense can thus be a d.c. voltage converter as well as an a.c. voltage converter. All conceivable topologies, such as step-up or step-down converters, reverse, flux, Sepic or Cuk converters,
as well as half-bridge or also full-bridge inverters, are possible here.

Further advantageous developments and embodiments of the inventive method and of the inventive circuit arrangement for making a lamp wattage available for operating at least one gas discharge lamp emerge from further dependent claims and from the following description.

BRIEF DESCRIPTION OF THE DRAWING(S)

Further advantages, features and details of the invention emerge on the basis of the following description of exemplary embodiments as well as on the basis of the drawings, in which the same or functionally equivalent elements are provided with identical reference characters. The drawings show:

FIG. 1 The block diagram of a circuit arrangement in a first embodiment of a first variant.

Figure 2:
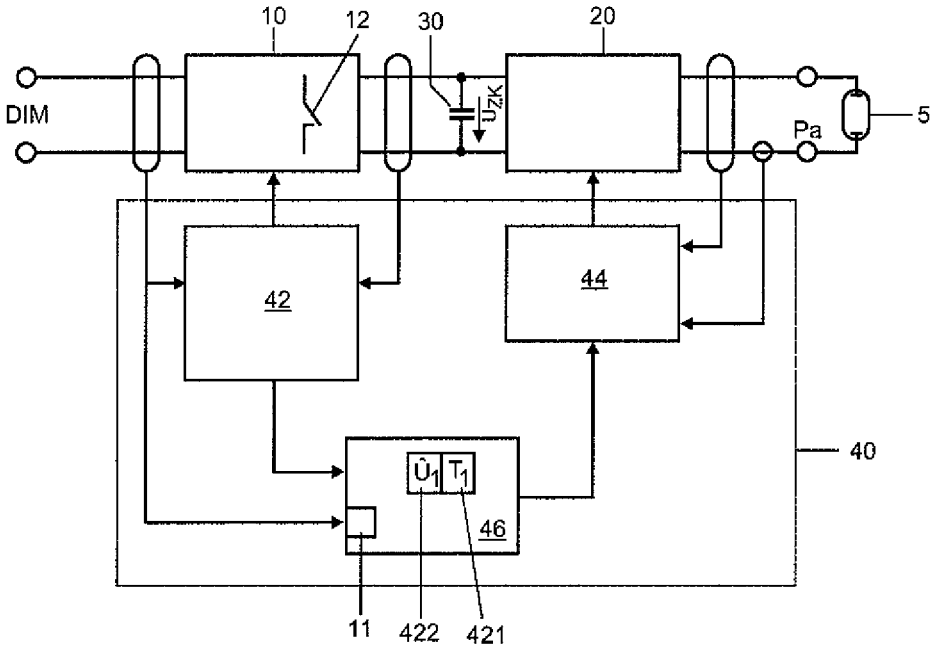

FIG. 2 The block diagram of a circuit arrangement in a second embodiment of a first variant.

Figure 3:
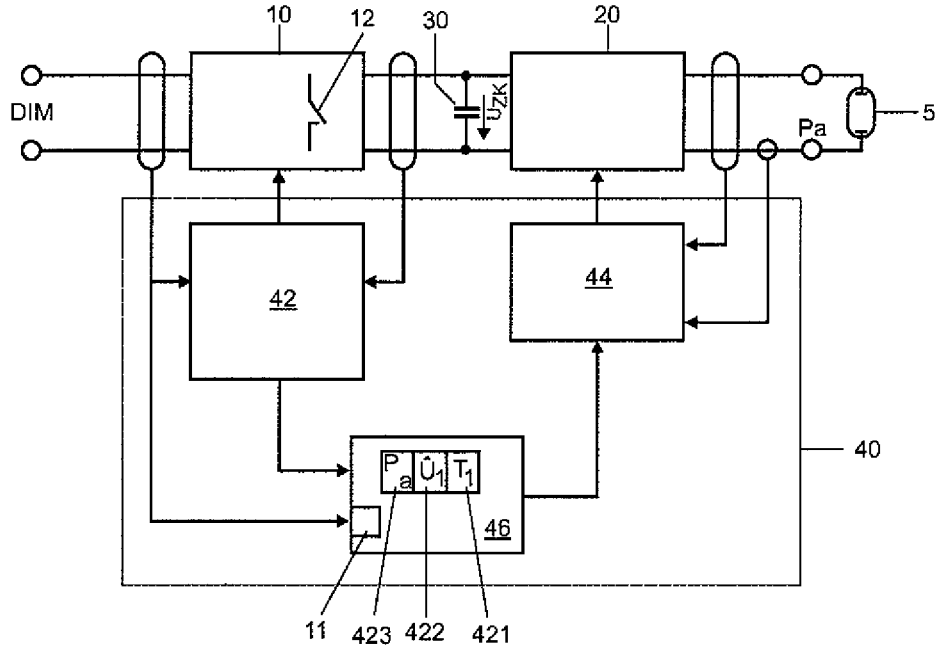

FIG. 3 The block diagram of a circuit arrangement in a third embodiment of a first variant.

Figure 4:
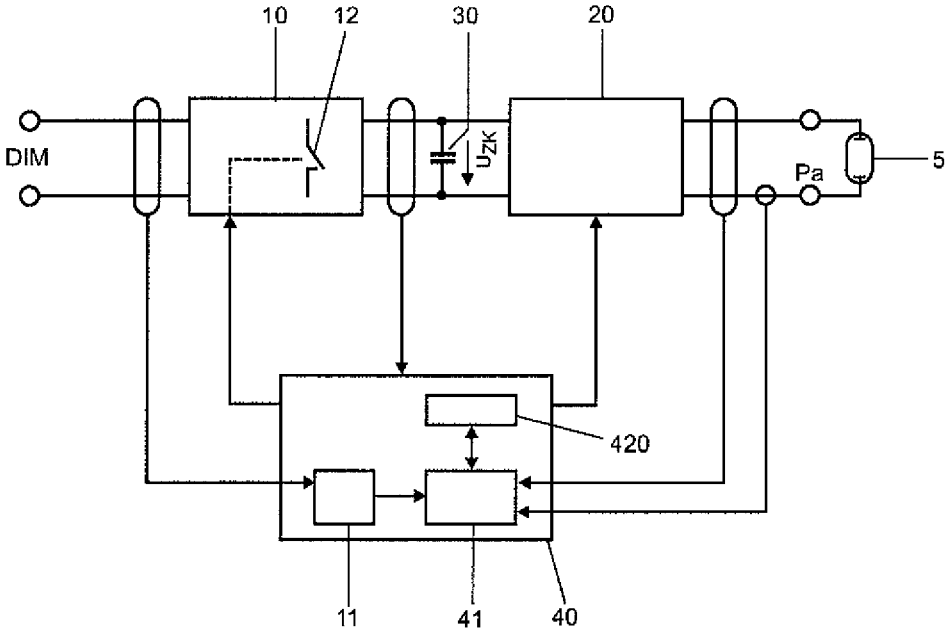

FIG. 4 The block diagram of a circuit arrangement of a second variant, in which the regulating circuits are implemented in an integrated switching circuit.

Figure 5:
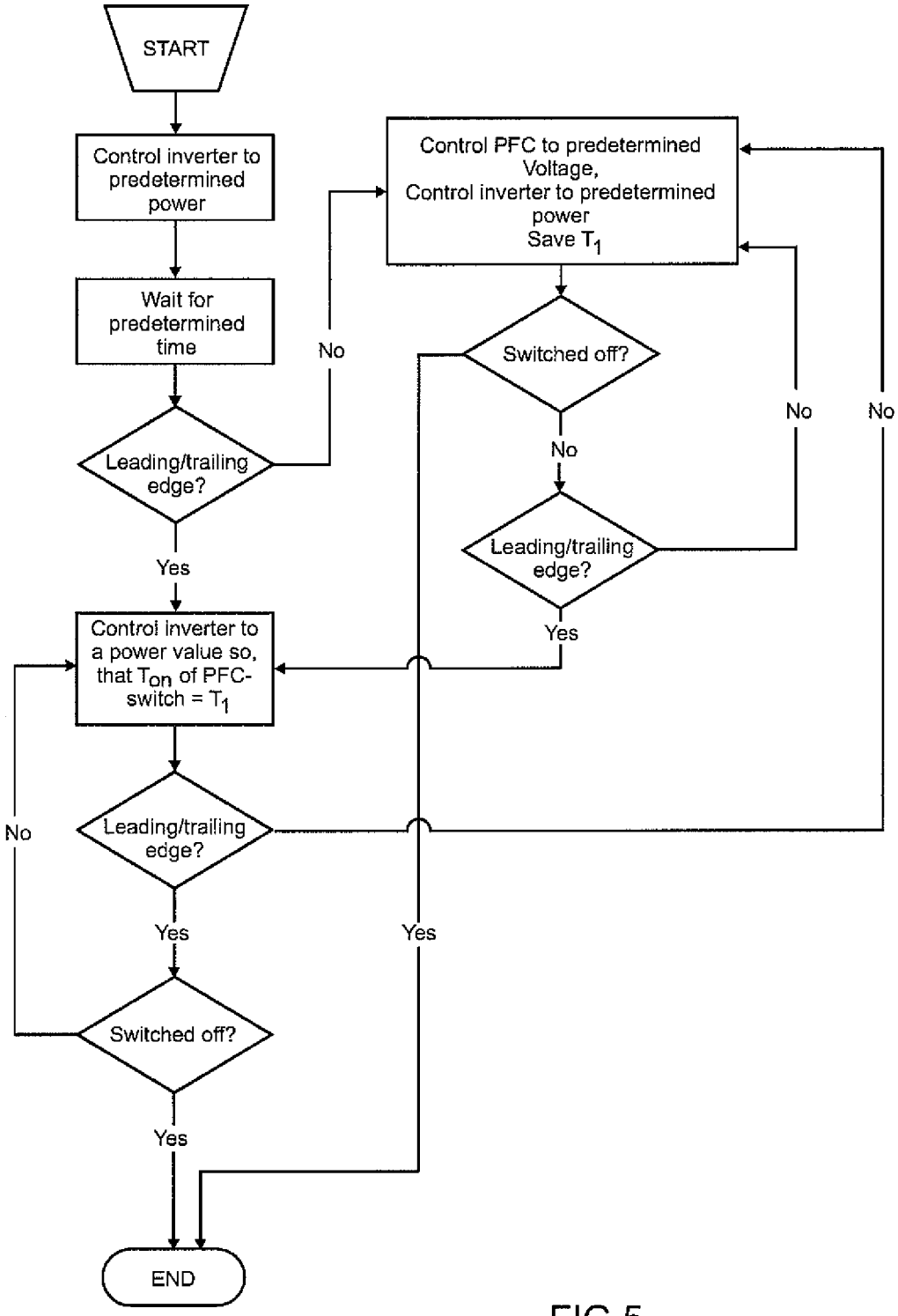

FIG. 5 A flow chart to illustrate the inventive method in a first embodiment.

Figure 6:
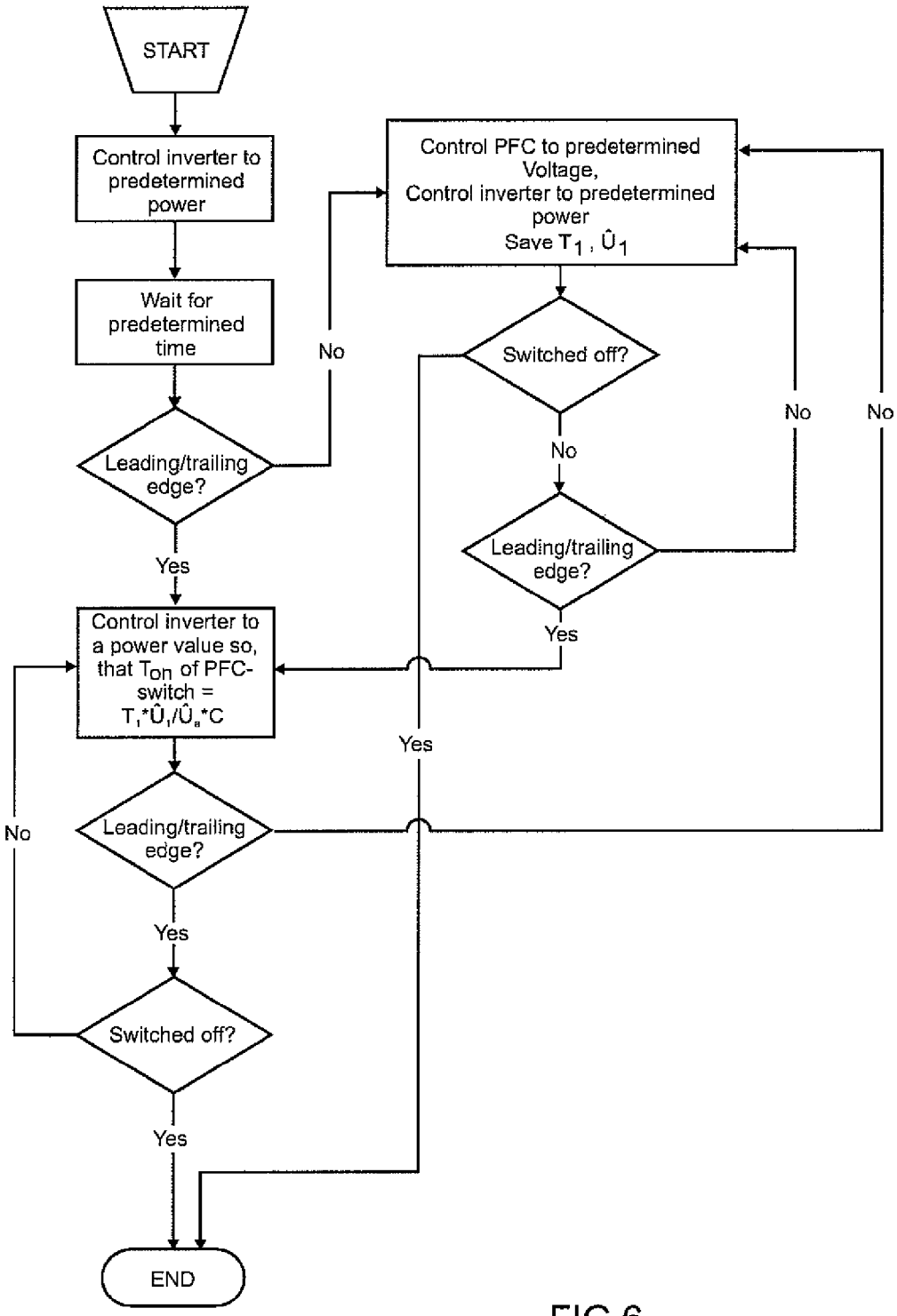

FIG. 6 A flow chart to illustrate the inventive method in a second embodiment.

Figure 7:
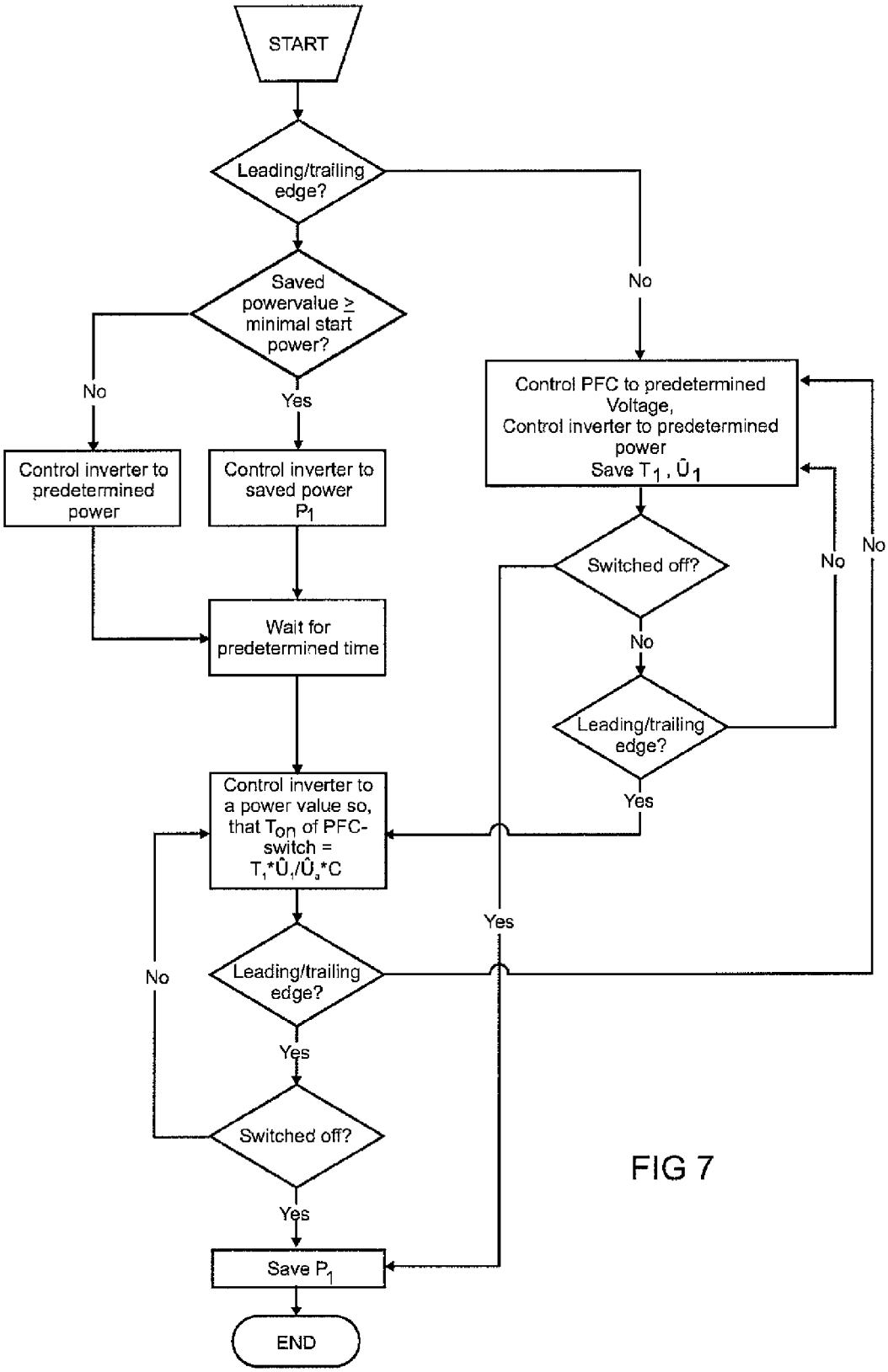

FIG. 7 A flow chart to illustrate the inventive method in a third embodiment.

DETAILED DESCRIPTION OF THE DRAWINGS

FIG. 1 shows the block diagram of a circuit arrangement of a first embodiment of a first variant. The circuit arrangement has an input DIM for inputting a supply voltage, which in the following is designated as a dimming signal, since it can have a phase leading edge, a phase trailing edge. The dimming signal DIM is normally generated from a line voltage by a commercially available phase leading edge dimmer or phase trailing edge dimmer (not shown). The dimming signal DIM is input into a wattage factor correction circuit 10 which at its output emits an intermediate circuit voltage $U_{ZK}$. The wattage factor correction circuit has a switch element 12, by means of which the intermediate circuit voltage $U_{ZK}$ is generated. This intermediate circuit voltage is input into an inverter 20 which from this intermediate circuit voltage generates an output signal for operating a gas discharge lamp 5. The circuit arrangement furthermore has a control circuit 40 containing several regulating circuits. A first regulating circuit 42 is used to regulate the wattage factor correction circuit 10. In order to accomplish this, the dimming signal DIM and the intermediate circuit voltage $U_{ZK}$ are recorded. The control circuit 40 furthermore has a second regulating circuit 44 which regulates the inverter 20. In order to accomplish this, the output voltage of the inverter and the output current of the inverter are recorded. The control circuit 40 furthermore has a third regulating circuit 46 which is superordinate to the first and the second regulating circuit and connects these to each other. The third regulating circuit 46 possesses a storage element 421 that can save a first variable that represents a dimension of a first switch-on time $T_1$ of the switch element 12. The third regulating circuit 46 furthermore has a detection unit 11. The detection unit 11 detects whether the dimming signal DIM has a phase leading edge or phase trailing edge.

As long as the dimming signal DIM now has no phase leading edge or phase trailing edge, the third regulating circuit 46 is ineffective. It merely saves, in a first storage element 421, a first variable that represents a dimension of a first switch-on time $T_1$ of the switch element 12. The first and the second regulating circuit 42 and 44 act independently of each other. The first regulating circuit 42 regulates the wattage factor correction circuit so that it emits a constant intermediate circuit voltage $U_{ZK}$. The second regulating circuit 44 regulates the inverter 20 such that it operates the gas discharge lamp 5 with a predetermined wattage. The predetermined wattage is in this case the rated wattage of the gas discharge lamp 5, in other words the nominal wattage of the gas discharge lamp 5 specified by the manufacturer.

As soon as the dimming signal DIM has a phase leading edge or phase trailing edge this is recorded by the detection unit 11 of the third regulating circuit 46. The third regulating circuit then becomes active and acts as a 'master', in other words controls the first and the second regulating circuits 42 and 44. The third regulating circuit reduces the allowed power to the inverter 20, and reads in the first variable, that represents a dimension of a first switch-on time $T_1$ of the switch element 12. At the same time the third regulating circuit reads in a variable, output by the first regulating circuit, for the current switch-on time $T_{ON}$ of the switch element 12. This current switch-on time $T_{ON}$ is now compared to the first switch-on time $T_1$. Since the dimming signal through the phase leading edge or phase trailing edge has a smaller RMS value, the current switch-on time $T_{ON}$ of the switch 12 is extended. The wattage of the inverter 20 is now reduced until the current switch-on time $T_{ON}$ again corresponds to the saved switch-on time $T_1$. If this is achieved, the dimming level of the gas discharge lamp 5 is exactly correlated with the phase angle of the dimming signal. This means that the bigger the phase leading edge or phase trailing edge of the dimming signal is, the lower the dimming level of the gas discharge lamp 5. This means that the gas discharge lamp 5 behaves as if it had been dimmed by the dimming signal DIM directly like a light bulb. It is not necessary here to measure the phase angle of the dimming signal. This measurement is very complex and computationally intensive, which would entail increased costs for the circuit arrangement. In the inventive method which the circuit arrangement executes, the circuit arrangement merely has to record whether a phase leading edge or phase trailing edge is present, but it does not need to measure the phase angle. The circuit arrangement can hence be executed at very low cost, since a fast microcontroller or expensive analog modules are not necessary.

FIG. 2 shows the block diagram of an inventive circuit arrangement in a second embodiment of a first variant. The second embodiment works similarly to the first embodiment, and hence merely the differences from the first embodiment are described. The second embodiment is distinguished in addition to the features of the first embodiment in that it adjusts the dimming level of the gas discharge lamp 5 independently of the fluctuations in the input line voltage, in other words of the dimming signal DIM. To this end the third regulator 46 has a further storage element 422 in addition to the first storage element 421.

As long as the dimming signal DIM has no phase leading edge or phase trailing edge, the third regulating circuit 46 saves a further variable, in addition to the first variable that represents a dimension of a first switch-on time $T_1$ of the switch element 12, and is saved in the first storage element 421. The second variable, which is a dimension of a first crest voltage value $\hat{U}_1$ of the dimming signal, is saved in the second storage element 422.

As soon as the dimming signal DIM has a phase leading edge or phase trailing edge, this is recorded by the detection unit 11 of the third regulating circuit 46. The third regulating circuit then becomes active and acts as a 'master', in other words with immediate effect it controls the first and the second regulating circuits 42 and 44. In order now to make the dimming level of the gas discharge lamp 5 independent of the voltage fluctuations of the dimming signal DIM, the third regulating circuit 46 measures a variable that is a dimension of the instantaneous crest voltage $\hat{U}_a$. Furthermore it reads in the variable that is a dimension of the saved first crest voltage $\hat{U}_1$, and the variable that represents a dimension of a first switch-on time $T_1$ of the switch element 12. Then the third regulating circuit 46 weights the measured instantaneous line voltage crest $\hat{U}_a$ with the read-in first crest voltage value $\hat{U}_1$, which emerges from the second variable such that the output wattage $P_1$ of the converter is adjusted such that the current switch-on time $T_{ON}$ of the switch element satisfies the following formula:

$$T_{ON} = T_1 \cdot \frac{\hat{U}_1}{\hat{U}_a} \cdot C;$$

C is here a correction factor dependent on the output wattage. It describes the change in the losses of the inverter 20 depending on the lamp voltage and the intermediate circuit voltage. In principle the correction factor C contains a model for the non-constant loss power of the inverter 20 in the case of different input and output parameters.

By weighting the measured instantaneous line voltage crest $\hat{U}_a$ with the read-in first crest voltage value $\hat{U}_1$ the dimming level becomes independent of the level of the dimming signal DIM. Since the dimming signal normally represents the line voltage after a dimmer, any voltage fluctuations in the line voltage are compensated for.

FIG. 3 shows the block diagram of an inventive circuit arrangement in a third embodiment of a first variant. The third embodiment works in a similar way to the second embodiment, and hence merely the differences from the second embodiment are described. In the third embodiment the wattage applied to the gas discharge lamp 5 before it is switched off is saved when the gas discharge lamp 5 is switched off, in order to readjust this wattage when the gas discharge lamp 5 is switched back on. In order to achieve this, a third variable, which is a dimension of a first lamp wattage $P_1$, is saved in a third storage element 423 in the third regulating circuit 46 before the gas discharge lamp 5 is switched off.

If the gas discharge lamp 5 is switched back on, the third regulating circuit 46 inquires whether the saved first lamp wattage $P_1$ is greater than or equal to a predetermined lamp startup wattage. Depending on the type of lamp, the predetermined initial wattage can assume different values. In the case of lamps which because of thermal restrictions of the lamp burner must always be started at full wattage, the predetermined initial wattage is accordingly the rated wattage of the gas discharge lamp 5. In the case of lamps which can be started with a lower wattage than the rated wattage, the predetermined initial wattage is correspondingly smaller than the rated wattage. Thus if the saved first lamp wattage $P_1$ is greater than or equal to the predetermined lamp startup wattage, the third regulating circuit 46 regulates the inverter in the case of a phase leading edge or a phase trailing edge such that it supplies the saved first lamp wattage $P_1$ to the gas discharge lamp. For the user this has the advantage that the lamp is automatically dimmed to the level to which it was dimmed before it was switched off.

If the saved lamp wattage $P_1$ is smaller than the predetermined lamp startup wattage, the third regulating circuit 46 thus regulates the inverter such that it supplies the predetermined lamp startup wattage to the gas discharge lamp.

After startup of the lamp there is a wait for a predetermined time (approx. 1-15 min) in which the wattage, in other words either the saved first lamp wattage $P_1$ or the lamp startup wattage, is present at the gas discharge lamp 5. This is necessary in order to stabilize the lamp burner thermally.

After this time the regulating circuit 46 regulates the inverter such that the current switch-on time $T_{ON}$ matches a switch-on time $T_c$ calculated using the formula $$T_C = T_1 \cdot \frac{\hat{U}_1}{\hat{U}_a} \cdot C.$$

Thus the dimming setting of the gas discharge lamp 5 is again compatible with the phase angle of the dimming signal DIM.

FIG. 4 shows the block diagram of an inventive circuit arrangement in a second variant. In this variant the wattage factor correction circuit 10 and the inverter 20 are controlled by a control circuit 40 which contains a microcontroller 41 with a memory 420. The detection unit 11 is likewise integrated into the control circuit 40. The control circuit 40 has the same inputs and outputs as the control circuit 40 in the first variant. Because the control circuit contains the microcontroller 41, all regulating operations can be undertaken centrally by the microcontroller 41. The regulating circuits are here implemented in software. The control circuit 40 thus likewise makes available a first, second and third regulating circuit, which work in the same way as described in the first variant.

Since the functionality is implemented digitally as software, it is significantly easier to implement features such as a dimming level independent of the voltage of the dimming signal or saving the dimming level on switch-off. This variant has a very low cost, since modern circuits such as e.g. operating devices for gas discharge lamps mostly already have a microcontroller for other reasons, and thus the additional functionality is primarily restricted to additional software, which keeps the costs low. The inventive method which executes the circuit arrangement offers in just such a configuration the invaluable advantage that because of the lack of phase angle measurement of the dimming signal a very low-wattage and thus low-cost microcontroller suffices. In the known dimming methods according to the prior art a phase angle measurement is mandatory and a high-wattage and thus expensive microcontroller is necessary.

A flow chart of the inventive method of a first embodiment is illustrated in FIG. 5. The method is based on an executing circuit arrangement as described e.g. in FIG. 1. In order to execute the inventive method, circuit arrangements with other topologies can however also be used. After startup the gas discharge lamp is started up for a predetermined time with a predetermined wattage. The predetermined wattage is, in the case of the standard gas discharge lamps, their rated wattage, in other words the nominal wattage specified by the manufacturer. In the case of advanced gas discharge lamps the predetermined wattage can however also be smaller than the rated wattage. It is then detected whether the dimming signal DIM has a phase leading edge or phase trailing edge, and in the case of a dimming signal DIM without a phase leading edge or phase trailing edge the wattage factor correction circuit is regulated such that it has a predetermined output voltage, and the inverter is regulated such that it outputs a wattage to the gas discharge lamp which corresponds to the rated wattage of the gas discharge lamp. Additionally the switch-on time $T_1$ of the switch element of the wattage factor correction circuit is saved. If the dimming signal DIM has a phase leading edge or phase trailing edge, the output wattage of the inverter is adjusted such that the current switch-on time $T_{ON}$ of the switch element corresponds to the wattage factor correction circuit of the saved switch-on time $T_1$.

The system continuously inquires in a loop whether the dimming signal DIM has a phase leading edge or phase trailing edge and whether the lamp should be switched off. In corresponding circumstances, the system branches to the corresponding operating points.

FIG. 6 shows the flow chart of the inventive method in a second embodiment. The method of the second embodiment is to a significant extent similar to that in the first embodiment. Hence only the differences from the first embodiment are described. The method of the second embodiment can be executed with a circuit arrangement as described in FIG. 2. However, other circuit topologies with which the inventive method can be executed are also conceivable. The significant difference from the first method lies in the fact that a fluctuation in the voltage of the dimming signal is equalized, and thus does not affect the adjusted dimming level. To this end a second variable is saved that represents a dimension of a first crest voltage value $\hat{U}_1$. This first crest voltage value $\hat{U}_1$ is offset with a current crest voltage value $\hat{U}_a$, in order to make the lamp wattage independent of the crest voltage of the dimming signal. In addition the loss power of the inverter 20 is also included in the calculation of the switch-on time $T_1$ of the switch element of the wattage factor correction circuit, in order to make the power regulation of the gas discharge lamp even more precise. To this end a correction factor C is introduced which reflects a model for the non-constant loss power of the inverter 20 in the case of different input and output parameters. In order to effect this, the current switch-on time $T_{ON}$ of the switch element of the wattage factor correction circuit is calculated using the following formula:

$$T_{ON} = T_1 \cdot \frac{\hat{U}_1}{\hat{U}_a} \cdot C;$$

the current switch-on time is here always calculated by means of this formula if the dimming signal has a phase leading edge or phase trailing edge.

FIG. 7 shows the flow chart of the inventive method in a third embodiment. The method of the third embodiment is to a significant extent similar to that in the second embodiment. Hence only the differences from the second embodiment are described. The difference from the second embodiment consists in the fact that before the gas discharge lamp is switched off a third variable is saved here, that represents a dimension of the instantaneous wattage $P_1$ of the gas discharge lamp. If the gas discharge lamp is switched back on, the system inquires whether the saved instantaneous wattage $P_1$ of the gas discharge lamp is greater than or equal to a predetermined lamp startup wattage. Depending on the type of lamp, the predetermined initial wattage can assume different values. In the case of older lamps, which because of thermal restrictions of the lamp burner must always be started at full wattage, the predetermined initial wattage is accordingly the rated wattage of the gas discharge lamp 5. In the case of more modern lamps which can be started with a lower wattage than the rated wattage, the predetermined initial wattage is correspondingly less than the rated wattage. If the saved instantaneous wattage $P_1$ of the gas discharge lamp is greater than or equal to a predetermined lamp startup wattage, then after startup the saved instantaneous wattage $P_1$ is applied to the lamp. If the saved instantaneous wattage $P_1$ of the gas discharge lamp is smaller than the predetermined lamp startup wattage, then after startup the predetermined lamp startup wattage is applied to the lamp.

After the lamp is started up there is a wait for a predetermined time (approx. 1 s-15 min), in which the wattage, in other words either the saved first lamp wattage $P_1$ or the lamp startup wattage, is applied to the gas discharge lamp 5. This is necessary in order to stabilize the lamp burner of the gas discharge lamp 5 thermally. The remaining part of the method of the third embodiment corresponds to the method of the second embodiment.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A method for making a lamp wattage available for operating at least one gas discharge lamp depending on a dimming signal which is input into a wattage factor correction circuit, having a switch element that is switched on clocked by a switch-on time, wherein the wattage factor correction circuit emits an intermediate circuit voltage which in turn is input into a converter that makes the lamp wattage available, comprising the steps of:

in an operating phase in which the dimming signal has no phase leading edge and no phase trailing edge, the wattage factor correction circuit and the converter are regulated independently of each other using a separate regulating circuit in each case; and in an operating phase in which the dimming signal has a phase leading edge or a phase trailing edge, the two independent regulating circuits are coupled to each other via a higher-order third regulating circuit such that the lamp wattage ($P_a$) of the converter is adjusted such that the switch-on time of the switch element in the wattage factor correction circuit corresponds to a predetermined time.

2. The method as claimed in claim 1, comprising the following repeatedly executing steps:

recognizing whether the dimming signal has a phase leading edge or a phase trailing edge;

regulating the switch-on time of the switch element such that the intermediate circuit voltage corresponds to a predetermined value and saving a first variable that represents a dimension of a first switch-on time of the switch element, as well as regulating the lamp wattage of the converter such that it matches a rated wattage of the discharge lamp if it was recognized that the dimming signal has no phase leading edge and no phase trailing edge; and reading in a first variable that represents a dimension of a first switch-on time of the switch element, and reducing the lamp wattage of the converter such that the switch element is in each case closed for the duration of the first switch-on time if it was recognized that the dimming signal has a phase leading edge or a phase trailing edge.

3. The method as claimed in claim 2, wherein furthermore a second variable that represents a dimension of a first crest voltage value of the dimming signal is saved simultaneously with the first variable, and the following additional steps are executed:

measuring an instantaneous crest voltage of the dimming signal, reading in the second variable that represents a dimension of a first crest voltage value, and weighting the measured instantaneous crest voltage with the read-in first crest voltage value which emerges from the second variable such that the lamp wattage of the converter is adjusted such that the current switch-on time of the switch element satisfies the following formula:

$$T_{ON} = T_1 \cdot \frac{\hat{U}_1}{\hat{U}_a} \cdot C;$$

C is here a correction factor dependent on the lamp wattage.

4. The method as claimed in claim 1, wherein, characterized in that the dimming signal is made available by a phase leading edge dimmer or phase trailing edge dimmer which has a dimming range of 50%-100%.

5. The method as claimed in claim 1, wherein before the gas discharge lamp is switched off a third variable that represents a dimension of a first lamp wattage of the converter is saved, and the following steps are executed when the gas discharge lamp is switched back on:

reading in the first and the third variable;

comparing the first lamp wattage with a predetermined lamp startup wattage, controlling the converter such that the lamp wattage matches the first lamp wattage of the discharge lamp if the first lamp wattage is greater than or equal to the predetermined lamp startup wattage;

controlling the converter such that the lamp wattage matches the predetermined lamp startup wattage of the discharge lamp if the first lamp wattage is smaller than the predetermined lamp startup wattage;

waiting for a predetermined period of time; and controlling the converter such that the lamp wattage has a variable, whereby the switch element is in each case closed for the duration of the calculated switch-on time.

6. A circuit arrangement for making a lamp wattage available for operating at least one gas discharge lamp, comprising:

an input for supplying a dimming signal;

an output for making a lamp wattage available for operating at least one gas discharge lamp;

a wattage factor correction circuit connected to the input with a controllable clocked switch element having a control input for ensuring a uniform power input of the circuit arrangement;

a converter connected to the output for generating the lamp wattage;

an intermediate circuit voltage which is present at the output of the wattage factor correction circuit and at the input of the converter;

a control unit having a control output for making a control signal available for the wattage factor correction circuit and a control signal for the converter at the control output;

a first storage element connected to the control unit for saving a first variable that represents a dimension of a first switch-on time of the switch element; and a detection unit connected to the input, which is designed in order to determine whether the dimming signal has a phase leading edge or a phase trailing edge, wherein in the event of a full wave being detected (no phase leading edge and no phase trailing edge) the first variable, that represents a dimension of the first switch-on time of the switch element, saved in the first storage element, regulates the converter such that a lamp wattage ($P_a$) is present at the output that matches a rated wattage of the gas discharge lamp, and wherein, in the event of a phase leading edge or a phase trailing edge being detected, the circuit arrangement reads out the first variable for the first switch-on time from the storage element and adjusts the lamp wattage ($P_a$) by controlling the converter such that the switch element of the wattage factor correction circuit is in each case closed for the duration of the switch-on time.

7. The circuit arrangement as claimed in claim 6, wherein the detection unit samples the dimming signal at a frequency that satisfies the following correlation: $\int_a \geqq 0.01 \cdot \int_{DIM}$.

8. The circuit arrangement as claimed in claim 6, wherein the control unit furthermore is designed to save a second variable in a second storage element, that represents a dimension of a first crest voltage value of the dimming signal.

9. The circuit arrangement as claimed in claim 8, wherein the circuit arrangement measures an instantaneous line voltage crest of the dimming signal, and weights the measured instantaneous line voltage crest with the first crest voltage value which emerges from the second variable such that the lamp wattage is made available by controlling the converter at a level such that the switch-on time of the switch element satisfies the following formula:

$$T_{ON} = T_1 \cdot \frac{\hat{U}_1}{\hat{U}_a} \cdot C;$$

C is here a correction factor dependent on the lamp wattage.

10. The circuit arrangement as claimed in claim 8, wherein the circuit arrangement has a further storage element for storing a third variable before the gas discharge lamp is switched off, wherein the third variable represents a dimension of a first lamp wattage, and the circuit arrangement comprises the following features:

a mimic for reading in the first and the third variable after the gas discharge lamp is switched on, a comparator for comparing the first lamp wattage with a predetermined lamp startup wattage, a device for controlling the converter such that the lamp wattage matches the first lamp wattage of the gas discharge lamp, if the first lamp wattage is greater than or equal to the predetermined lamp startup wattage, a device for controlling the converter such that the lamp wattage matches the predefined lamp startup wattage of the gas discharge lamp if the first lamp wattage is smaller than the predetermined lamp startup wattage, a delay device which allows the wattage applied to the gas discharge lamp to be applied for a predetermined period of time, and a regulating circuit for adjusting the converter such that the lamp wattage has a variable at which the switch element is in each case closed for the duration of the calculated switch-on time.

11. The circuit arrangement as claimed in claim 6, wherein the control unit has a microcontroller, and the detection unit is formed by corresponding wiring and software of the microcontroller.

* * * * *